US011830642B2

(12) United States Patent
Sato et al.

(10) Patent No.: US 11,830,642 B2
(45) Date of Patent: Nov. 28, 2023

(54) MOVABLE CONTACT, VARIABLE RESISTOR, AND METHOD FOR MANUFACTURING MOVABLE CONTACT

(71) Applicant: Tokyo Cosmos Electric Co., Ltd., Kanagawa (JP)

(72) Inventors: Masaru Sato, Kanagawa (JP); Syunsuke Aoki, Kanagawa (JP); Hideki Nakano, Kanagawa (JP)

(73) Assignee: Tokyo Cosmos Electric Co., Ltd., Zama (JP)

( * ) Notice: Subject to any disclaimer, the term of this patent is extended or adjusted under 35 U.S.C. 154(b) by 0 days.

(21) Appl. No.: 17/914,369

(22) PCT Filed: Mar. 25, 2021

(86) PCT No.: PCT/JP2021/012543
§ 371 (c)(1),
(2) Date: Sep. 26, 2022

(87) PCT Pub. No.: WO2021/200539
PCT Pub. Date: Oct. 7, 2021

(65) Prior Publication Data

US 2023/0113682 A1 Apr. 13, 2023

(30) Foreign Application Priority Data

Mar. 30, 2020 (JP) ..... 2020-060653

(51) Int. Cl.
*H01C 10/34* (2006.01)

(52) U.S. Cl.
CPC ..... *H01C 10/34* (2013.01)

(58) Field of Classification Search
CPC ..... H01C 10/34; H01C 10/14; H01C 10/32; H01C 10/00; H01C 9/02; H01G 5/00; H01F 21/06

(Continued)

(56) References Cited

U.S. PATENT DOCUMENTS

| | | | |
|---|---|---|---|
| 4,184,140 | A | 1/1980 | Frey, Jr. et al. |
| 5,047,746 | A | 9/1991 | Stilwell et al. |
| 2005/0282446 | A1 | 12/2005 | Gehlert et al. |

FOREIGN PATENT DOCUMENTS

| | | |
|---|---|---|
| GB | 1087773 | 10/1967 |
| JP | 60-196902 | 10/1985 |

(Continued)

OTHER PUBLICATIONS

International Search Report and the Written Opinion dated Jun. 15, 2021 From the International Searching Authority Re. Application No. PCT/JP2021/012543 and Its Translation Into English. (13 Pages).

(Continued)

*Primary Examiner* — Edwin A. Leon
*Assistant Examiner* — Iman Malakooti

(57) ABSTRACT

Provided are a movable contact, a variable resistor, and a method for manufacturing a movable contact that can suppress a cost increase. The movable contacts are spaced apart from each other. The variable resistor, having a resistor, an electrode and the movable contact, comprises: a first wire rod group which has a plurality of first wire rods made of a precious metal and in which the plurality of first wire rods are arranged along the resistor; a second wire rod group which has a plurality of second wire rods made of a metal other than the precious metal and in which the plurality of second wire rods are arranged along the electrode; and a shaft-shaped member which is disposed to cross the first wire rod group and the second wire rod group and is welded to the first wire rod group and the second wire rod group.

4 Claims, 3 Drawing Sheets

(58) Field of Classification Search
USPC ..... 338/68, 116, 162
See application file for complete search history.

(56) References Cited

FOREIGN PATENT DOCUMENTS

| | | | | |
|---|---|---|---|---|
| JP | 01-313819 | | 12/1985 | |
| JP | 01-313819 | | 12/1989 | |
| JP | 03-211701 | | 9/1991 | |
| JP | 09-219304 | | 8/1997 | |
| JP | H09219304 | * | 8/1997 | ..... H01C 10/00 |
| JP | 2003-045707 | | 2/2003 | |
| JP | 2003045707 | * | 2/2003 | ..... H01C 10/32 |

OTHER PUBLICATIONS

Supplementary European Search Report and the European Search Opinion dated Aug. 22, 2023 From the European Patent Office Re. Application No. 21782207.1. (8 Pages).

* cited by examiner

MOVABLE CONTACT, VARIABLE RESISTOR, AND METHOD FOR MANUFACTURING MOVABLE CONTACT

TECHNICAL FIELD

The present invention relates to a movable contact, a variable resistor, and a method for manufacturing the movable contact.

BACKGROUND ART

A variable resistor in the related art includes: a board; a resistor printed with a lead-containing ink on the board; and a contact part made of beryllium copper, which moves while being in contact with the resistor, for example.

In recent years, lead-free materials and electronic components both of which do not use lead have been desired in terms of global environmental conservation. However, there is a problem that a variable resistor including a resistor printed with a lead-free ink and a contact part made of beryllium copper cannot obtain adequate properties.

It is known to use a contact part made of a precious metal as a contact part which moves while being in contact with a resistor in order to obtain adequate properties. For example, Patent Literature (hereinafter referred to as "PTL") 1 discloses a variable resistor including: a support part made of a copper alloy; a contact part made of copper alloy, which is formed integrally with the support part and moves while being in contact with an electrode; and a contact part made of a precious metal alloy, which is welded and fixed to the support part via an attachment member and moves while being in contact with a resistor.

CITATION LIST

Patent Literature

PTL 1
Japanese Patent Application Laid-Open No. 2003-45707

SUMMARY OF INVENTION

Technical Problem

Incidentally, the variable resistor described in PTL 1 has a problem of a cost increase since the contact part made of a precious metal alloy is welded and fixed to the support part via the attachment member so that the number of components and the assembly man-hours of components increase.

An object of the present invention is to provide a movable contact, a variable resistor, and a method for manufacturing the movable contact each capable of suppressing a cost increase.

Solution to Problem

To achieve the above object, a movable contact in the present invention is included in a variable resistor. The variable resistor includes: a resistor; an electrode; and the movable contact. The resistor and the electrode are disposed apart from each other and extend in a predetermined direction which is identical. The movable contact moves in the predetermined direction while being in contact with the resistor and the electrode. The movable contact includes:

a first wire rod group including a plurality of first wire rods made of a precious metal, in which the plurality of first wire rods is arranged so as to be along the resistor and is arranged in an orthogonal direction orthogonal to the predetermined direction;

a second wire rod group including a plurality of second wire rods made of a metal other than the precious metal, in which the plurality of second wire rods is arranged so as to be along the electrode and is arranged in the orthogonal direction; and a shaft-shaped member which is disposed so as to cross the first wire rod group and the second wire rod group and is welded to the first wire rod group and the second wire rod group.

Further, a variable resistor in the present invention includes:

the movable contact; and a resistor and an electrode with which the movable contact is movably in contact.

Further, a method for manufacturing a movable contact in the present invention includes:

disposing a first wire rod group and a second wire rod group, in which the first wire rod group is a wire rod group in which a plurality of first wire rods made of a precious metal is arranged in an orthogonal direction orthogonal to an extending direction of an axis of the plurality of first wire rods, the second wire rod group is a wire rod group in which a plurality of second wire rods made of a metal other than the precious metal and having an axial diameter larger than an axial diameter of the plurality of first wire rods is arranged in an orthogonal direction orthogonal to an extending direction of an axis of the plurality of second wire rods, and the first wire rod group and the second wire rod group are disposed adjacent to each other in the orthogonal direction;

disposing a shaft-shaped member such that the shaft-shaped member is disposed so as to cross the first wire rod group and the second wire rod group; and welding the shaft-shaped member to the first wire rod group and the second wire rod group by resistance welding.

Advantageous Effects of Invention

The present invention makes it possible to suppress a cost increase.

DESCRIPTION OF EMBODIMENTS

Hereinafter, an embodiment of the present invention will be described with reference to the accompanying drawings.

Figure 1:
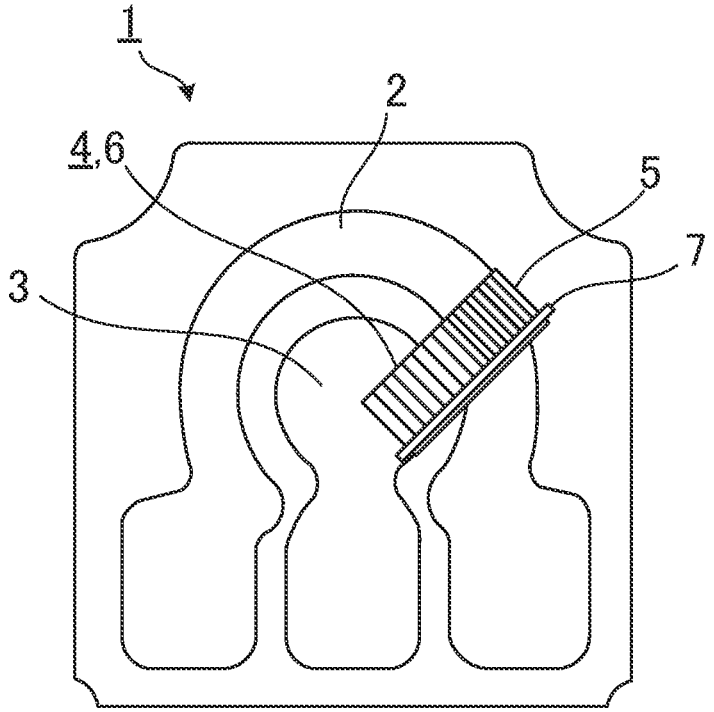
FIG. 1 schematically illustrates a variable resistor according to an embodiment of the present invention.
Figure 2:
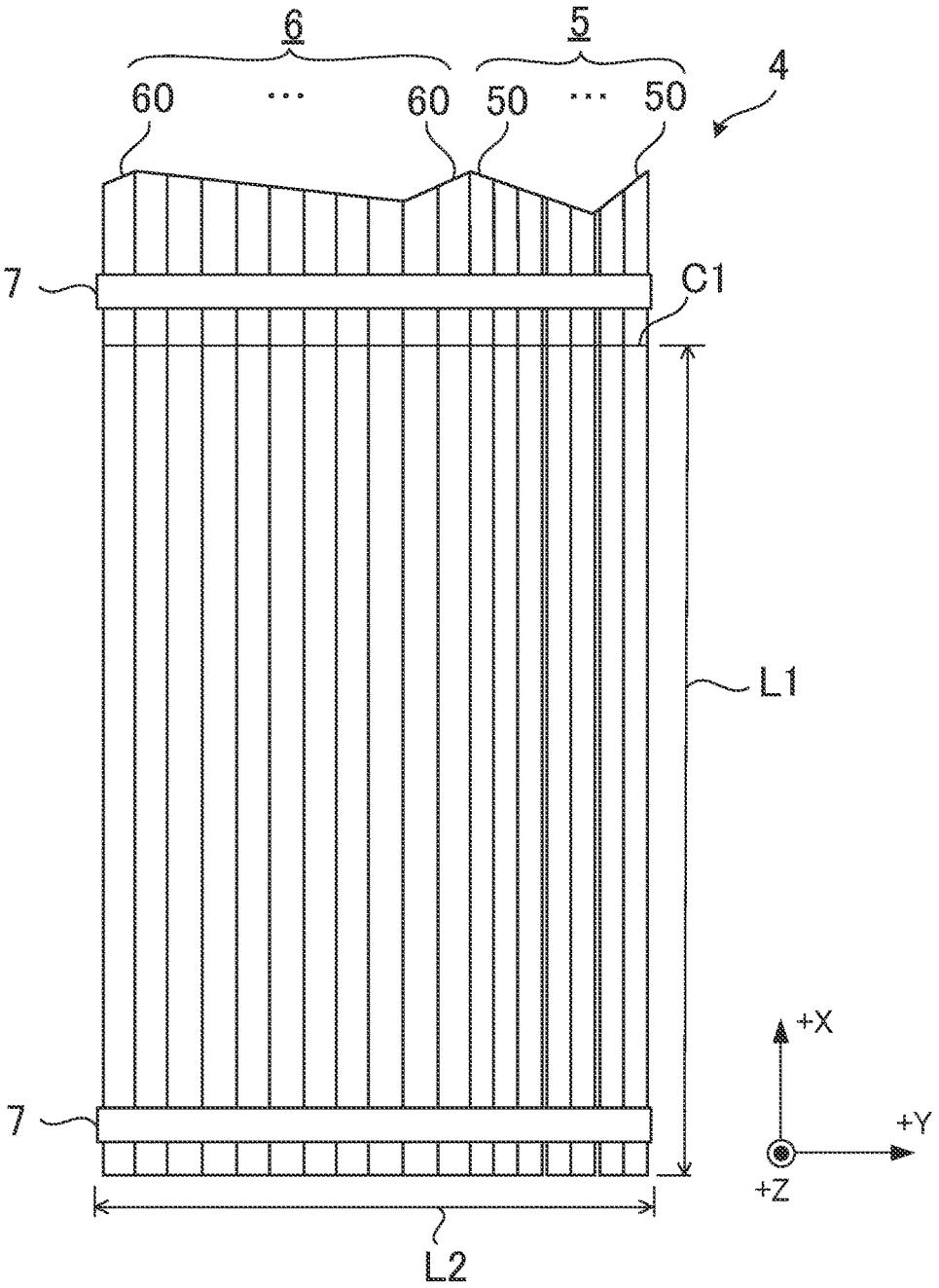
FIG. 2 is a plan view schematically illustrating a movable contact according to the embodiment of the present invention.
Figure 3:
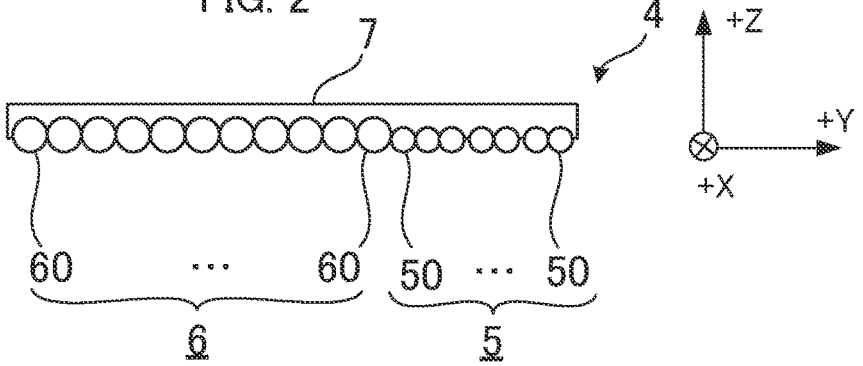
FIG. 3 is a front view schematically illustrating the movable contact according to the embodiment of the present invention.

FIG. 1 schematically illustrates a variable resistor according to the embodiment of the present invention. FIG. 2 is a plan view schematically illustrating a movable contact according to the embodiment of the present invention. FIG. 3 is a front view schematically illustrating the movable contact according to the embodiment of the present invention. FIG. 2 depicts the X, Y, and Z axes. In FIG. 2, the up-down direction is referred to as the X direction or the axial direction, the up direction is referred to as the one side in the axial direction or the "+X direction", and the down direction is referred to as the other side in the axial direction or the "−X direction". Further, the left-right direction is referred to as the Y direction or the arrangement direction, the right direction is referred to as the outer side in the arrangement direction or the "+Y direction", and the left direction is referred to as the inner side in the arrangement direction or the "−Y direction". Further, the direction orthogonal to the paper surface is referred to as the pressurization direction, the frontward side is referred to as the one side in the pressurization direction or the "+Z direction", and the rearward side is referred to as the other side in the pressurization direction or the "−Z direction".

As illustrated in FIG. 1, variable resistor 1 includes resistor 2, electrode 3, and movable contact 4.

Resistor 2 is printed in a circumferential shape on a board (not illustrated) with an ink of ruthenium oxide, for example. The direction of a circumference corresponds to the "predetermined direction" in the present invention.

Electrode 3 is printed in a circumferential shape on the board with an ink of silver palladium, for example. Resistor 2 and electrode 3 are disposed apart from each other in a direction (radial direction) orthogonal to the direction of the circumference. More specifically, electrode 3 is disposed in a center part of the circumference described above.

Movable contact 4 includes first wire rod group 5, second wire rod group 6, and shaft-shaped member 7.

First wire rod group 5 includes a plurality of (for example, seven) first wire rods 50 made of a precious metal. Here, the precious metal encompasses, for example, gold, silver, and platinum group metals including platinum (palladium, rhodium, ruthenium, osmium, and iridium). As illustrated in FIG. 2, first wire rod 50 extends in the X direction. First wire rod 50 has predetermined length L1 in the X direction. The plurality of first wire rods 50 is arranged in the Y direction. Further, as illustrated in FIGS. 1 and 2, the arrangement direction (the Y direction) here is a direction orthogonal to the axis of first wire rod 50 and is the direction (radial direction) orthogonal to the predetermined direction (the direction of the circumference). First wire rod group 5 is disposed on the outer side in the arrangement direction (the +Y direction) so as to be along resistor 2.

Second wire rod group 6 includes a plurality of (for example, eleven) second wire rods 60 made of a metal other than the precious metal. Here, the metal other than the precious metal encompasses, for example, beryllium copper. As illustrated in FIG. 2, second wire rod 60 extends in the X direction. Second wire rod 60 has predetermined length L1 in the X direction. The plurality of second wire rods 60 is arranged in the Y direction. As illustrated in FIGS. 1 and 2, the arrangement direction (the Y direction) here is a direction orthogonal to the axis of second wire rod 60 and is a direction orthogonal to the predetermined direction. Second wire rod group 6 is arranged on the inner side in the arrangement direction (the —Y direction) so as to be along electrode 3.

An axial diameter of second wire rod 60 is larger than an axial diameter of first wire rod 50. For example, the axial diameter of second wire rod 60 is four thirds of the axial diameter of first wire rod 50. Note that, the reason why the axial diameter of second wire rod 60 is larger than the axial diameter of first wire rod 50 is that second wire rod 60 having a larger diameter comes first and first wire rod 50 having a smaller diameter comes later in an order in which a pressure is applied at the time of resistance welding so that a time when first wire rod 50 starts to melt is caused to be later than a time when second wire rod 60 starts to melt. That is, the reason is that first wire rod group 5 and second wire rod group 6 can be welded at one time by adjusting each melting amount of first wire rod 50 and second wire rod 60 in accordance with the axial diameter.

For shaft-shaped member 7, a copper wire is used, for example, and shaft-shaped member 7 has predetermined length L2 in the Y direction. Shaft-shaped member 7 is disposed on the one side in the pressurization direction (the +Z direction) with respect to first wire rod group 5 and second wire rod group 6 so as to cross first wire rod group 5 and second wire rod group 6 and is welded to first wire rod group 5 and second wire rod group 6.

Figure 4A:
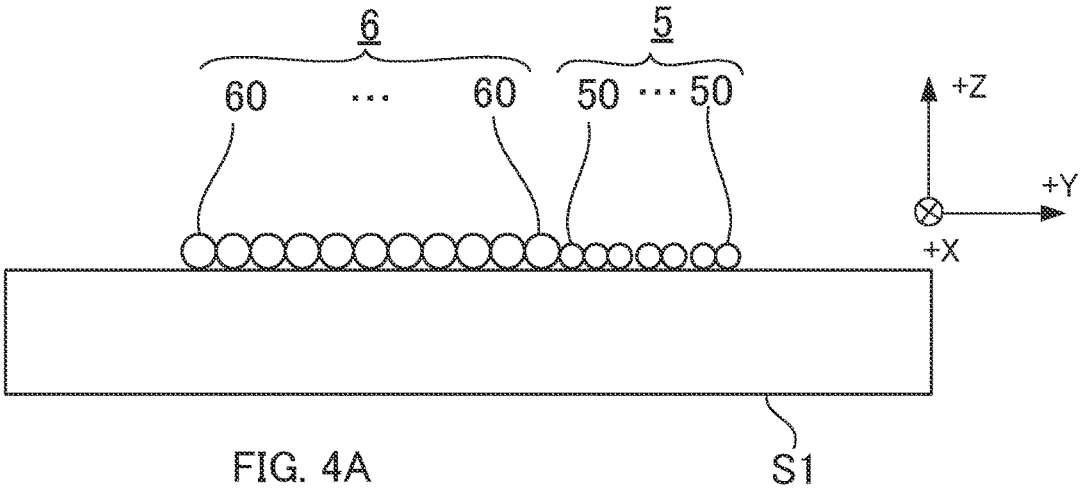
FIG. 4A illustrates a wire rod group disposing step in an example of a method for manufacturing the movable contact.
Figure 4B:
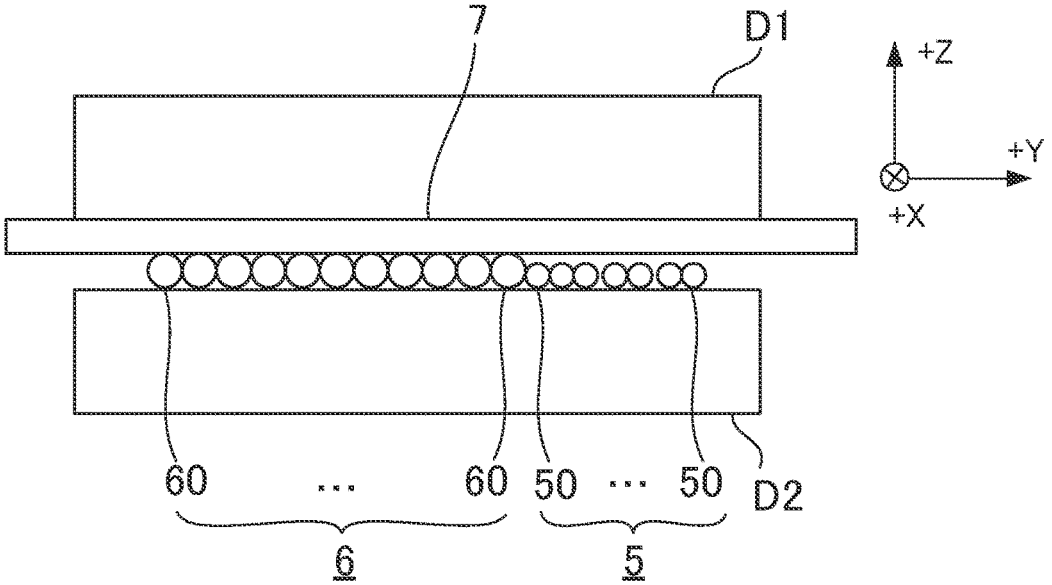
FIG. 4B illustrates a welding step in the example of the method for manufacturing the movable contact.
Figure 4C:
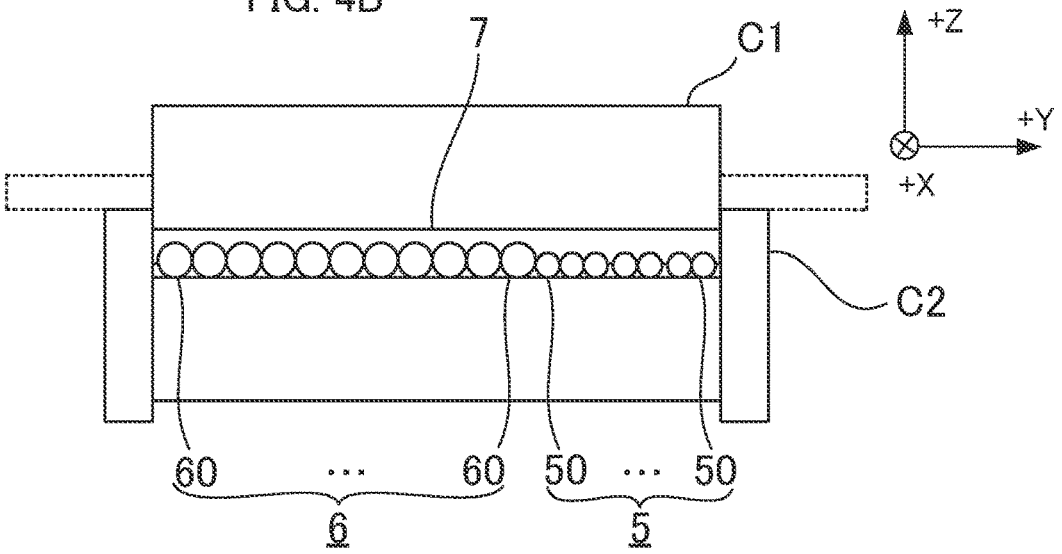
FIG. 4C illustrates a cutting step in the example of the method for manufacturing the movable contact.

Next, an example of a method for manufacturing movable contact 4 will be described with reference to FIGS. 4A to 4C. FIG. 4A illustrates a wire rod group disposing step in an example of the method for manufacturing movable contact 4. FIG. 4B illustrates a welding step in the example of the method for manufacturing the movable contact. FIG. 4C illustrates a cutting step in the example of the method for manufacturing movable contact 4.

In the following description, a position where shaft-shaped member 7 is disposed with respect to first wire rod group 5 and second wire rod group 6 will be referred to as "shaft-shaped member disposition position". Further, a position where shaft-shaped member 7 is welded to first wire rod group 5 and second wire rod group 6 will be referred to as "welding position". Further, a position where first wire rod group 5 and second wire rod group 6 are cut will be referred to as "wire rod group cutting position". Further, a position where shaft-shaped member 7 is cut will be referred to as "shaft-shaped member cutting position". Further, a direction in which each axis of first wire rod 50 and second wire rod 60 extends will be referred to as "extending direction". Further, in the following description, the wire rod group cutting position and the shaft-shaped member cutting position are disposed at the same position with respect to each other in the extending direction, but the wire rod group cutting position may be disposed downstream of the shaft-shaped member cutting position in the extending direction.

In the wire rod group disposing step (see FIG. 4A), first wire rod group 5 and second wire rod group 6 are disposed adjacent to each other in the X direction on stage S1. Note that, in the wire rod group disposing step, first wire rod group 5 and second wire rod group 6 are not cut to predetermined length L1 (see FIG. 2). First wire rod group 5 and second wire rod group 6 are cut in the cutting step (to be described later). Here, each of first wire rods 50 of first wire rod group 5 and second wire rods 60 of second wire rod group 6 is continuous in the extending direction. For example, each of first wire rods 50 having a coil shape and second wire rods 60 having a coil shape is stretched and disposed as first wire rod group 5 and second wire rod group 6 on stage S1.

First wire rod group 5 and second wire rod group 6 are fed from stage S1 to the shaft-shaped member disposition position (the welding position). Note that, the distance from stage S1 to the shaft-shaped member disposition position (the welding position) is a length one time or a predetermined plurality of times predetermined length L1.

In a shaft-shaped member disposing step, shaft-shaped member 7 is disposed on the one side in the pressurization direction (the +Z direction) with respect to first wire rod group 5 and second wire rod group 6 so as to cross first wire rod group 5 and second wire rod group 6. Note that, in this shaft-shaped member disposing step, shaft-shaped member 7 is not cut to predetermined length L2 (see FIG. 2). Shaft-shaped member 7 is cut in the cutting step (to be described later).

At the welding position (see FIG. 4B), welding electrode D1 is disposed on the one side in the pressurization direction (the +Z direction) of shaft-shaped member 7 and welding electrode D2 is disposed on the other side in the pressurization direction (the −Z direction) of first wire rod group 5 and second wire rod group 6.

In the welding step, shaft-shaped member 7 is welded to first wire rod group 5 and second wire rod group 6. Since the axial diameter of second wire rod 60 is larger than the axial diameter of first wire rod 50, second wire rod group 6 is pressurized by welding electrodes D1 and D2 prior to first wire rod group 5. Thus, a portion at which second wire rod group 6 and shaft-shaped member 7 are in contact with each other melts.

After the portion at which second wire rod group 6 and shaft-shaped member 7 are in contact with each other melts, first wire rod group 5 and shaft-shaped member 7 come into contact with each other, albeit not illustrated, and a portion at which first wire rod group 5 and shaft-shaped member 7 in contact with each other melts. That is, it is configured such that a time when first wire rod group 5 starts to melt is later than a time when second wire rod group 6 starts to melt. In other words, it is configured such that a substantial welding time of first wire rod group 5 is shorter than a substantial welding time of second wire rod group 6. Thus, the melting amount of first wire rod 50 having a smaller diameter becomes smaller than the melting amount of second wire rod 60 having a larger diameter so that it is possible to prevent first wire rod 50 from excessively melting. Given the above, at the time when the welding step ends, each melting amount of first wire rod 50 and second wire rod 60 is adjusted in accordance with the axial diameter so that a step of welding shaft-shaped member 7 to first wire rod group 5 and a step of welding shaft-shaped member 7 to second wire rod group 6 can be performed at one time without performing both separately.

First wire rod group 5 and second wire rod group 6 to both of which shaft-shaped member 7 is welded are fed from the shaft-shaped member disposition position (the welding position) to the wire rod group cutting position (the shaft-shaped member cutting position). Note that, the distance from the shaft-shaped member disposition position (the welding position) to the wire rod group cutting position (the shaft-shaped member cutting position) is a length one time or a predetermined plurality of times predetermined length L1.

In the cutting step (see FIG. 4C), first wire rod group 5 and second wire rod group 6 are cut to predetermined length L1 (see FIG. 2) at a position between a plurality of the shaft-shaped members adjacent to each other in the extending direction. Further, shaft-shaped member 7 is cut to predetermined length L2 by cutting molds C1 and C2 (see FIG. 2). Thus, movable contact 4 is manufactured.

Movable contact 4 according to the embodiment of the invention described above is included in variable resistor 4. Variable resistor 4 includes: resistor 2; electrode 3; and movable contact 4. Resistor 2 and electrode 3 are disposed apart from each other and extend in a predetermined direction which is identical. Movable contact 4 moves in the predetermined direction while being in contact with resistor 2 and electrode 3. Movable contact 4 includes: first wire rod group 5 including a plurality of first wire rods 50 made of a precious metal, in which the plurality of first wire rods 50 is arranged so as to be along resistor 2 and is arranged in an orthogonal direction orthogonal to the predetermined direction; second wire rod group 6 including a plurality of second wire rods 60 made of a metal other than the precious metal, in which the plurality of second wire rods 60 is arranged so as to be along electrode 3 and is arranged in the orthogonal direction; and shaft-shaped member 7 which is disposed so as to cross first wire rod group 5 and second wire rod group 6 and is welded to first wire rod group 5 and second wire rod group 6.

The above configuration decreases the number of components and the assembly man-hours of components by a simple structure in which shaft-shaped member 7 is welded to first wire rod group 5 and second wire rod group 6 so that it is possible to suppress a cost increase.

Further, the method for manufacturing a movable contact in the embodiment of the invention described above includes: disposing first wire rod group 5 and second wire rod group 6, in which first wire rod group 5 is a wire rod group in which a plurality of first wire rods 50 made of a precious metal is arranged in an orthogonal direction orthogonal to an extending direction of an axis of the plurality of first wire rods 50, second wire rod group 6 is a wire rod group in which a plurality of second wire rods 60 made of a metal other than the precious metal and having an axial diameter larger than an axial diameter of the plurality of first wire rods 50 is arranged in an orthogonal direction, and first wire rod group 5 and second wire rod group 6 are disposed adjacent to each other in the orthogonal direction; disposing shaft-shaped member 7 such that shaft-shaped member 7 is disposed so as to cross first wire rod group 5 and second wire rod group 6; and welding shaft-shaped member 7 to first wire rod group 5 and second wire rod group 6 by resistance welding.

With the above configuration, second wire rod 60 having a larger diameter comes first and first wire rod 50 having a smaller diameter comes later in an order in which a pressure is applied at the time of resistance welding. Thus, a time when first wire rod 50 starts to melt is later than a time when second wire rod 60 starts to melt. Thus, it is configured such that first wire rod 50 is prevented from excessively melting. As a result, it is possible to weld first wire rod group 5 and second wire rod group 6 at one time.

Further, in the method for manufacturing movable contact 4 according to the embodiment of the invention described above, in the welding, shaft-shaped member 7 is welded to first wire rod group 5 and second wire rod group 6 each time first wire rod group 5 and second wire rod group 6 are fed in the extending direction by a predetermined length, and the method includes cutting first wire rod group 5 and second wire rod group 6 at a position between a plurality of shaft-shaped members 7 which is welded to first wire rod group 5 and second wire rod group 6 and is adjacent to each other in the extending direction.

Thus, it is possible to manufacture movable contact 4 as a product by sequentially feeding first wire rod group 5 and second wire rod group 6 between the steps without cutting first wire rod group 5 and second wire rod group 6 and by cutting first wire rod group 5 and second wire rod group 6 in the cutting step that is the final step. As a result, movable contact 4 is continuously manufactured so that it is possible to further suppress a cost increase.

In addition, any of the embodiment described above is only illustration of an exemplary embodiment for implementing the present invention, and the technical scope of the present invention shall not be construed limitedly thereby. That is, the present invention can be implemented in various forms without departing from the gist thereof or the main features thereof.

This application is based on Japanese patent application No. 2020-060653, filed on Mar. 30, 2020, the contents of which are incorporated herein by reference.

INDUSTRIAL APPLICABILITY

The present invention is suitably utilized in a variable resistor including a movable contact which is required to suppress a cost increase.

REFERENCE SIGNS LIST

1 Variable resistor
2 Resistor
3 Electrode
4 Movable contact
5 First wire rod group
6 Second wire rod group
7 Shaft-shaped member
50 First wire rod
60 Second wire rod

The invention claimed is:

1. A movable contact included in a variable resistor, wherein the variable resistor includes: a resistor; an electrode; and the movable contact, the resistor and the electrode being disposed apart from each other and extending in a predetermined direction which is identical, the movable contact moving in the predetermined direction while being in contact with the resistor and the electrode, the movable contact comprising:

a first wire rod group including a plurality of first wire rods made of a precious metal, the plurality of first wire rods being arranged so as to be along the resistor and being arranged in an orthogonal direction orthogonal to the predetermined direction;

a second wire rod group including a plurality of second wire rods made of a metal other than the precious metal, the plurality of second wire rods being arranged so as to be along the electrode and being arranged in the orthogonal direction, the second wire rod group being disposed adjacent to the first wire rod group in the orthogonal direction, an axial diameter of the plurality of second wire rod being larger than an axial diameter of the plurality of first wire rods; and a shaft-shaped member which is disposed so as to cross in a straight line the first wire rod group and the second wire rod group and is welded to the first wire rod group and the second wire rod group.

2. A variable resistor, comprising:

the movable contact according to claim 1; and a resistor and an electrode with which the movable contact is movably in contact.

3. A method for manufacturing a movable contact, comprising:

disposing a first wire rod group and a second wire rod group, the first wire rod group being a wire rod group in which a plurality of first wire rods made of a precious metal is arranged in an orthogonal direction orthogonal to an extending direction of an axis of the plurality of first wire rods, the second wire rod group being a wire rod group in which a plurality of second wire rods made of a metal other than the precious metal and having an axial diameter larger than an axial diameter of the plurality of first wire rods is arranged in an orthogonal direction orthogonal to an extending direction of an axis of the plurality of second wire rods, the first wire rod group and the second wire rod group being disposed adjacent to each other in the orthogonal direction;

disposing a shaft-shaped member such that the shaft-shaped member is disposed so as to cross in a straight line the first wire rod group and the second wire rod group; and welding the shaft-shaped member to the first wire rod group and the second wire rod group by resistance welding.

4. The method for manufacturing the movable contact according to claim 3, wherein:

in the welding, the shaft-shaped member is welded to the first wire rod group and the second wire rod group each time the first wire rod group and the second wire rod group are fed in the extending direction by a predetermined length, and the method includes cutting the first wire rod group and the second wire rod group at a position between a plurality of shaft-shaped members which is welded to the first wire rod group and the second wire rod group and is adjacent to each other in the extending direction.

* * * * *